United States Patent [19]

Eberle et al.

[11] 3,942,668

[45] Mar. 9, 1976

[54] LOW TEMPERATURE STORAGE CONTAINER

[75] Inventors: Richard Francis Eberle, Pardeeville; John Alden Kroetz, Sun Prairie, both of Wis.

[73] Assignee: W. R. Grace & Co., New York, N.Y.

[22] Filed: Jan. 30, 1975

[21] Appl. No.: 545,571

[52] U.S. Cl. ..... 220/8; 220/4 B; 220/14; 220/17

[51] Int. Cl.[2] ..... B65D 7/24

[58] Field of Search ..... 220/4 B, 4 E, 8, 17, 63 R, 220/14; 229/9, 19, 87.2, 93; 206/443, 503, 535, 536; 211/60 R, 74

[56] References Cited

UNITED STATES PATENTS

| | | | |
|---|---|---|---|
| 665,776 | 1/1901 | Fletcher | 211/74 X |
| 2,620,941 | 12/1952 | Smulski | 220/8 |
| 2,630,233 | 3/1953 | Kircher | 211/74 X |
| 3,024,076 | 3/1962 | Van Wulfften-Palthe | 206/535 X |
| 3,036,145 | 5/1962 | Murphy | 220/8 X |
| 3,052,370 | 9/1962 | Haumann | 220/14 X |
| 3,108,840 | 10/1963 | Conrad et al. | 220/17 X |
| 3,130,836 | 4/1964 | Conrad | 206/535 X |
| 3,187,937 | 6/1965 | Berta | 220/94 R |
| 3,716,135 | 2/1973 | Koebler et al. | 206/535 |

FOREIGN PATENTS OR APPLICATIONS

| | | | |
|---|---|---|---|
| 824,702 | 12/1959 | United Kingdom | 220/14 |
| 980,681 | 1/1965 | United Kingdom | 220/14 |
| 984,095 | 2/1965 | United Kingdom | 220/14 |

*Primary Examiner*—William Price
*Assistant Examiner*—Stephen Marcus
*Attorney, Agent, or Firm*—Elton Fisher

[57] ABSTRACT

An elongated container substantially round in cross section comprising a substantially round elongated hollow female member having a closed end, an open end, and a peripheral opening extending from the closed end to the open end, and a substantially round elongated hollow male member having a first end, a second end, a peripheral opening extending from one end to the other, and a plurality of fingers attached to and extending inward from the periphery of the first end, the male member being slidably and rotatably inserted into the female member with the second end of the male member adjacent to the closed end of the female member.

14 Claims, 6 Drawing Figures

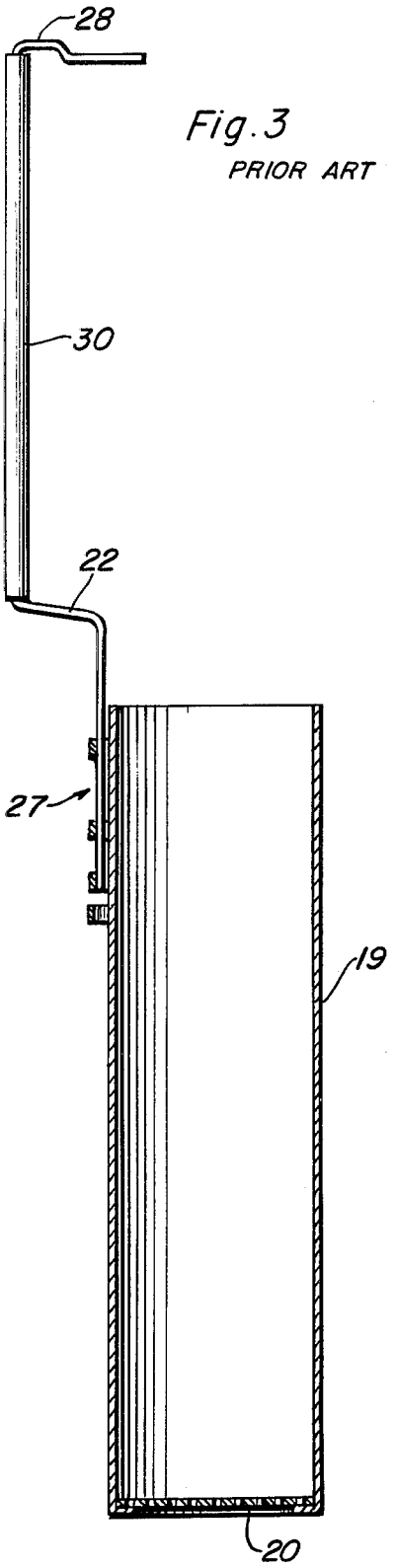
Fig. 3
PRIOR ART
Fig. 4
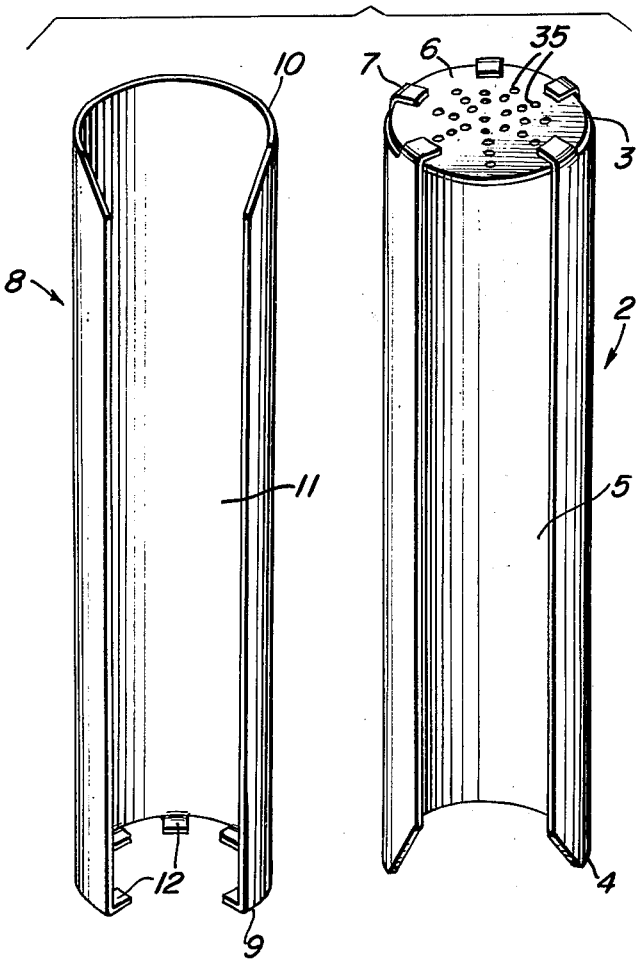

LOW TEMPERATURE STORAGE CONTAINER

BACKGROUND OF THE INVENTION

This invention is directed to a container useful for storing and dispensing biological specimens including blood specimens, cultures, vaccines, animal semen, and the like. Such specimens are frequently sealed in glass ampules, plastic ampules, glass tubes, or plastic tubes (plastic straws), and the like. The ampules, or tubes, or straws containing such specimens are immersed in a refrigerant such as liquid nirogen and are removed from the refrigerant as needed.

The container of this invention is well adapted for holding or containing such ampules, or tubes, or straws when they (the ampules, tubes, or straws) are immersed in the refrigerant and for dispersing one or more such ampules, tubes, or straws when the content thereof is needed.

The container of this invention is especially useful for storing and dispersing straws containing semen for breeding cattle.

Extensive field tests led to the introduction in the early 1950's of commercial techniques which have shown that semen, properly collected and frozen, can be stored for long periods and distributed economically in the frozen state. Economics and advantages in the distribution of frozen semen are such that most of the artificial breeding of dairy cattle in the United States has been converted to this technique. Generally, the procedure involves collecting the semen, packaging it in a suitable container, such as an ampule or a slender plastic straw measuring about five inches in length, and storing the package in a suitable refrigerating apparatus maintained at a temperature of about −320°F by means of liquid nitrogen.

Recently, the straw has gained favor as the most desirable container for use in the artificial breeding system. The straw containing the semen carries such information as the name of the sire, registration number, code number, batch identification, and any other information that may be desired.

Prior art containers are taught by U.S. Pat. No. 3,716,133 (206/65A, Koebler) and U.S. Pat. No. 3,743,104 (211/60, Peterson).

U.S. Pat. No. 3,187,937 (220/94, Berta) describes a canister which can be used to suspend the container of this invention in a liquid refrigerant such as liquid nitrogen.

SUMMARY OF THE INVENTION

In summary, this invention is directed to a container for containing and dispensing tubes, straws, ampules, or the like containing biological specimens which are stored in a liquid refrigerant such as liquid nitrogen. Hence, it is an object of this invention to provide a container which is useful for storing and dispensing ampules, tubes, straws and the like which contain biological specimens.

BRIEF DESCRIPTION OF THE DRAWINGS

FIG. 3 is a vertical cross-section of said canister showing the storage area thereof.

FIG. 4 is a vertical view of the female and male members which, where assembled, comprise a container of this invention.

DETAILED DESCRIPTION OF THE INVENTION

Figure 1:
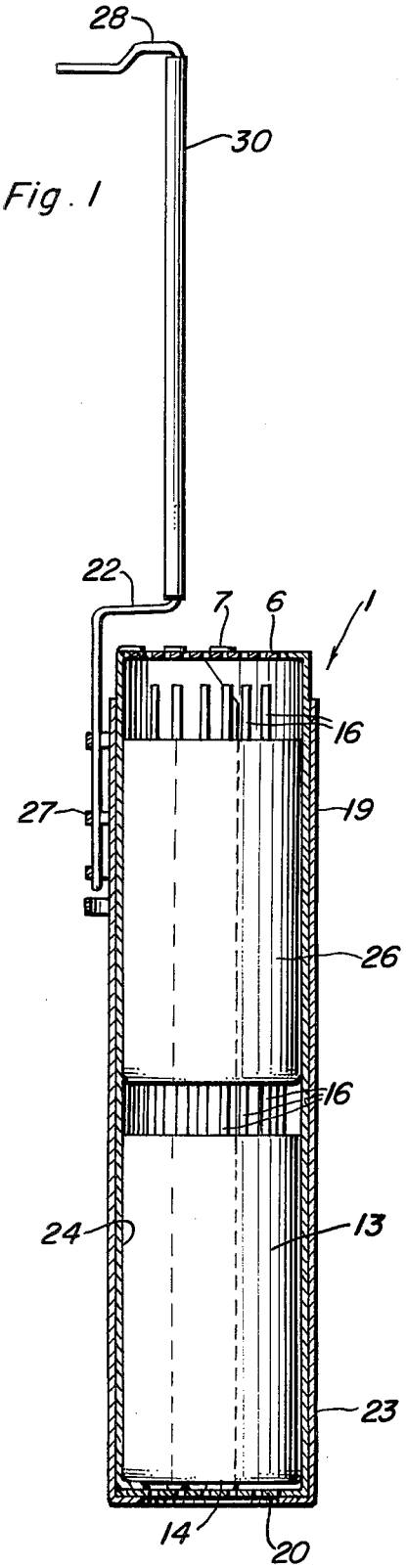
FIG. 1 is a vertical cross-section of a container of this invention, with storage straws therein, positioned in a canister adapted for supporting the container in a liquid refrigerant.
Figure 2:
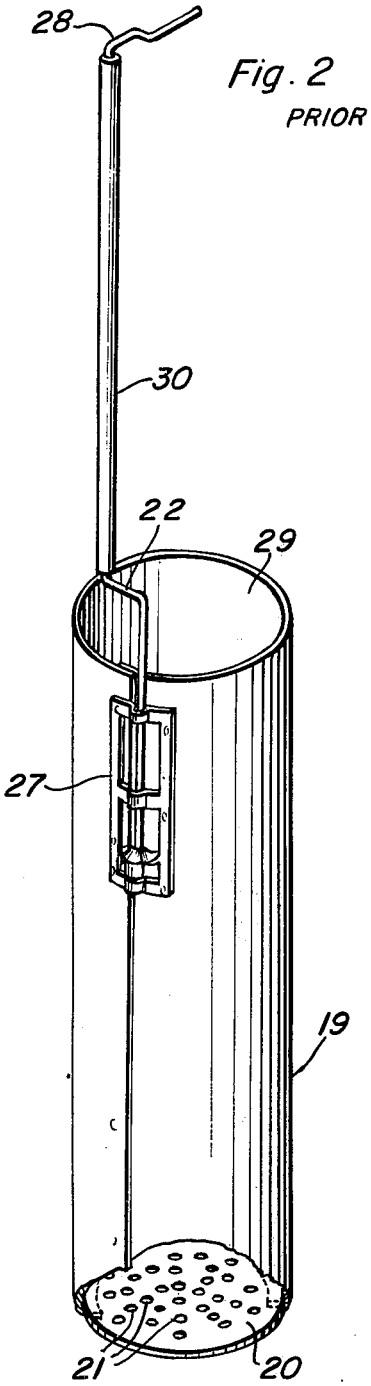
Fig. 2 PRIOR ART
FIG. 2 is a vertical view of said canister with parts cut away to show the bottom thereof.

Although canister 19 does not constitute a part of this invention, it does constitute a convenient device for supporting the container of this invention in a liquid refrigerant such as liquid nitrogen. The container of this invention shown generally at one of FIG. 1 and FIG. 5 can be positioned in the canister as shown in FIG. 1 and the loaded canister can then be placed in the liquid refrigerant (e.g., as taught by the above-mentioned U.S. Pat. No. 3,187,937). The canister, when immersed in the liquid refrigerant is supported by hook 28 which constitutes a part of canister handle 22. Handle 22 can be hinged as shown at 27 and a portion (or all) of the handle can be insulated as shown at 30. Canister 19 preferably has a plurality of holes 21 in its bottom 20 to permit liquid refrigerant to enter and contact the container of this invention.

The female member (outer member) is shown generally at 2 of FIG. 4. The top end of said female member is shown at 3, and its bottom end is shown at 4. The peripheral opening of the female member is shown at 5.

Top end 3 of female member 2 is closed with member 6 which is supported by fingers 7 which extend inward from the periphery of the top end 3 of female member 2. Alternatively, member 6 can be an intregral part of female member 2 or it can be welded or bolted directly to female member 2. If desired, holes 35 can be provided in member 6. Alternatively, member 6 can be attached to female member 2 in such manner as to leave openings between member 6 and female member 2. The male member (inner member) is shown at 8. The top end of male member 8 is shown at 10 and the bottom end of said member 8 is shown at 9. Fingers 12 extend inward from the periphery of member 8. In an equivalent embodiment fingers 12 can be replaced with rods or bolts extending inward from end 9 of male member 8. Said rods or bolts can be welded or bolted to the bottom end 9 of member 8. Peripheral opening 11 of male member 8 extends from end 9 to end 10.

Figure 5:
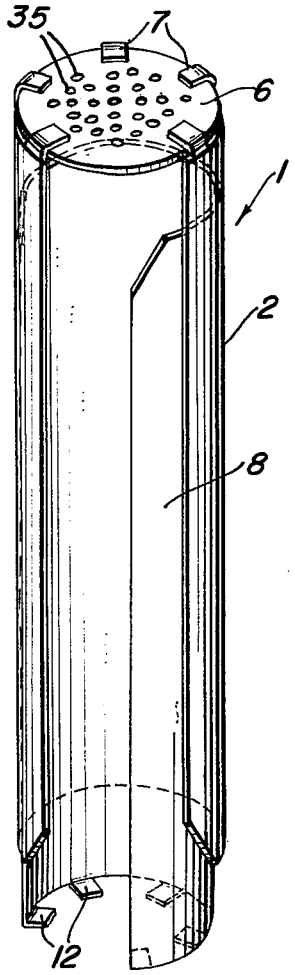
FIG. 5 is a vertical view of said female and male members assembled to form a container of this invention.

Female member 2 and male member 8 are assembled as shown in FIG. 5 to form container 1, the container of this invention.

Figure 6:
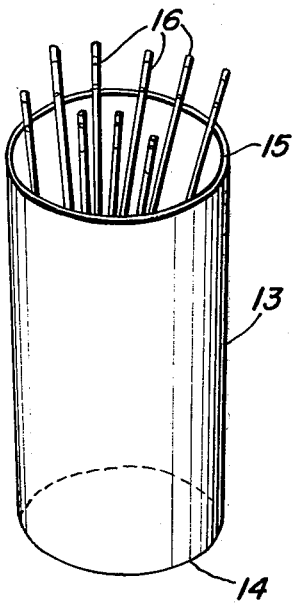
FIG. 6 is a vertical view of a plastic cup, with plastic straws therein, which can be inserted into said male member, before assembling the female and male members, to provide support for the plastic straws which contain the stored biological material.

Plastic cup 13, shown in FIG. 6, has a closed end 14 and an open end 15. Said cup is adapted to contain straws (or ampules or tubes) 16 which can contain biological specimens (e.g., animal semen or the like) to be refrigerated.

Plastic cups 13 and 26 (each containing straws 16) can be positioned one above the other (as shown in FIG. 1) within container 1 which can be positioned within canister 19 for storage in a liquid refrigerant.

It is generally preferred that female member 2, fingers 7, member 6, male member 8, and fingers 12 be made of metal (most preferably stainless steel). However, other materials such as plastic can be used with excellent results.

If it is desired to place biological samples in ampules, tubes, straws, or the like in a container 1 of this invention (e.g., in the container of Embodiments A or C, supra) without the use of a first plastic cup 13 or a second plastic cup 26, a bottom (e.g., a metal disc, a plastic disc (e.g., a polypropyline disc, a polyethylene disc, or a nylon disc) or a screen or wire mesh disc) can be supported by fingers 12. If desired, the disc can contain perferations or holes. Such disc can then be used to support the ampules, tubes, straws, or the like (which contain the biological samples) within container 1.

If it is desired to dispense with canister 19, container 1 (the container of this invention) can be inserted in a box (or cylinder) having a bottom and a handle (or arm or wire) attached thereto, and container 1 in such box (or cylinder) can be inserted into the liquid refrigerant. Such box or cylinder can be made of metal sheets, plastic (e.g., polyethylene, polypropylene, or nylon), or screen or wire mesh. Such box or cylinder can be perforated to permit the liquid refrigerant to make direct contact with container 1. Alternatively, a handle (or wire or arm) can be attached to container 1 which can then be inserted into the liquid refrigerant and recovered therefrom by such handle.

Polyethylene, polypropylene, and nylon are preferred plastics for use in constructing plastic cups 13 and 26.

We claim:

1. An elongated container substantially round in cross section comprising:

a. a substantially round elongated hollow female member having: (i) a first end; (ii) a second end; and (iii) a peripheral opening extending from the first end to the second end;

b. an end wall positioned on the first end of the female member;

c. a substantially round elongated hollow male member having: (i) a first end; (ii) a second end; and (iii) a peripheral opening extending from the first end to the second end slidably inserted into the female member with the first end of the male member adjacent to the second end of the female member, the male member being rotatable where inserted into the female member; and d. a plurality of fingers attached to and extending inward from the periphery of the first end of the male member.

2. The elongated container of claim 1 in which the width of the peripheral opening of the female member is equal to about one-fourth to one-third of the circumference of said member.

3. The elongated container of claim 2 in which the width of the peripheral opening of the male member is equal to about one-fourth to one-third of the circumference of said member.

4. The elongated container of claim 1 in which its length is about 4–5 times its diameter.

5. The elongated container of claim 4 in which the male member and the female member are substantially the same length.

6. An elongated container for storing and transporting hollow tubes containing animal semen comprising:

a. a substantially round elongated hollow female member having: (i) a top end; (ii) a bottom end; and (iii) a peripheral opening extending from the top end to the bottom end;

b. an end wall positioned on the top end of the female member;

c. a substantially round elongated hollow male member having: (i) a top end; (ii) a bottom end; and (iii) a peripheral opening extending from the top end to the bottom end slidably inserted into the female member with the top end of the male member adjacent to the top end of the female member, the male member being rotatable where inserted into the female member;

d. a plurality of fingers attached to and extending inward from the periphery of the bottom end of the male member;

e. a first substantially round resilient plastic cup having a closed end and an open end, the first cup being slidably and rotatably positioned within the substantially round hollow elongated male member, the closed end of said cup being positioned against and supported by the fingers attached to and extending inward from the periphery of the bottom end of said male member to close the bottom end of said male member, the first plastic cup being adapted to receive and contain the hollow tubes containing the animal semen;

f. a second substantially round resilient plastic cup having a closed end and an open end the cup being slidably and rotatably positioned within the substantially round male member, the closed end of the second plastic cup being adjacent to the open end of the first plastic cup, the second plastic cup being adapted to receive and contain the hollow tubes containing the animal semen.

7. The elongated container of claim 6 in which the width of the peripheral opening of the female member is equal to about one-fourth to one-third of the circumference of said member.

8. The elongated container of claim 6 in which the width of the peripheral opening of the male member is equal to about one-fourth to one-third of the circumference of said member.

9. The elongated container of claim 6 in which the length of the container is about 4–5 times its diameter.

10. The elongated container of claim 6 in which the male member and the female member are substantially the same length.

11. An elongated container substantially round in cross-section comprising:

a. a hollow substantially round elongated female member having a closed end, an open end, and a peripheral opening extending from the closed end to the open end;

b. a hollow substantially round elongated male member having a first end, a second end, and a peripheral opening extending from the first end to the second end slidably and rotatably seated in the female member with the second end of the male member adjacent to the closed end of the female member;

c. a plurality of fingers attached to and extending inward from the periphery of the first end of the male member.

12. An elongated container for storing and transporting hollow tubes containing mammalian semen comprising:

a. a hollow substantially round elongated female member having a closed end, an open end, and a peripheral opening extending from the closed end to the open end;

b. a hollow substantially round elongated male member having a first end, a second end, and a peripheral opening extending from the first end to the second end slidably and rotatably seated in the female member with the second end of the male member adjacent to the closed end of the female member;

c. a plurality of fingers attached to and extending inward from the periphery of the first end of the male member;

d. a first substantially round resilient plastic cup having a closed end and an open end slidably and rotatably seated within the male member with the closed end of the cup positioned against and supported by the fingers attached to and extending inward from the periphery of the first end of the male member, the cup being adapted to receive and contain the hollow tubes containing the semen;

e. a second substantially round resilient plastic cup having a closed end and an open end slidably and rotatably seated within the male member with the closed end of the second plastic cup adjacent to the open end of the first plastic cup, the second plastic cup being adapted to receive and contain the hollow tubes containing the semen.

13. The container of claim 12 in which the width of the peripheral opening of the female member is equal to about one-fourth to one-third of the circumference of said member.

14. The container of claim 13 in which the width of the peripheral opening of the male member is equal to about one-fourth to one-third of the circumference of said member.

* * * * *